US007153209B2

(12) United States Patent
Rothkranz et al.

(10) Patent No.: US 7,153,209 B2
(45) Date of Patent: Dec. 26, 2006

(54) GAMING DEVICE HAVING INDEPENDENTLY LINEARLY MOVEABLE SYMBOL INDICATORS

(75) Inventors: Markus Rothkranz, Las Vegas, NV (US); Thomas D. Waxman, Reno, NV (US); Jeffrey F. Macedo, Sparks, NV (US)

(73) Assignee: IGT, Reno, NV (US)

( * ) Notice: Subject to any disclaimer, the term of this patent is extended or adjusted under 35 U.S.C. 154(b) by 839 days.

(21) Appl. No.: 10/243,048

(22) Filed: Sep. 12, 2002

(65) Prior Publication Data

US 2004/0053670 A1 Mar. 18, 2004

(51) Int. Cl.
*A63F 9/24* (2006.01)

(52) U.S. Cl. ..... 463/22; 463/20; 273/143 R

(58) Field of Classification Search ..... 463/16–20, 463/30, 58–59, 6–7; 273/141 R, 142 R, 273/143 R, 349–440, 138.1, 139
See application file for complete search history.

(56) References Cited

U.S. PATENT DOCUMENTS 2,545,644 A 3/1951 Benton et al.
3,572,712 A * 3/1971 Vick ..... 463/60
3,975,022 A 8/1976 Figueroa
4,410,178 A 10/1983 Partridge
4,695,053 A 9/1987 Vazquez, Jr. et al.
4,732,386 A 3/1988 Rayfiel
5,152,529 A 10/1992 Okada
5,364,100 A 11/1994 Ludlow et al.
5,395,111 A 3/1995 Inoue
5,449,173 A 9/1995 Thomas et al.
5,560,603 A 10/1996 Seelig et al.
5,584,763 A 12/1996 Kelly et al.
5,664,998 A 9/1997 Seelig et al.
5,823,872 A 10/1998 Prather et al.
5,823,874 A 10/1998 Adams et al.
D400,597 S 11/1998 Hedrick et al.
D402,702 S 12/1998 Seelig et al.
5,848,932 A 12/1998 Adams
D406,865 S 3/1999 Heidel
5,882,261 A 3/1999 Adams
5,911,418 A 6/1999 Adams et al.
5,927,714 A 7/1999 Kaplan
5,976,015 A 11/1999 Seelig et al.
6,004,207 A 12/1999 Wilson, Jr. et al.
6,007,429 A * 12/1999 Lubniewski ..... 463/50

(Continued)

FOREIGN PATENT DOCUMENTS

GB 338504 11/1930

(Continued)

OTHER PUBLICATIONS

Slot Machines and Coin-Op Games, Copyright 1991 Quintet Publishing Limited, 4 pages.*

(Continued)

*Primary Examiner*—John M. Hotaling, II
*Assistant Examiner*—Alex F. R. P. Rada, II
(74) *Attorney, Agent, or Firm*—Bell, Boyd & Lloyd LLC

(57) ABSTRACT

A gaming device having one or more independently linearly moveable symbol indicators. In one embodiment, the gaming device displays an award amount to the player using the mechanical symbol indicators. Each mechanical symbol indicator includes a symbol display that is linearly movable within the housing of the gaming device. One or more indicator members mark which numbers or symbols on the symbol displays when the symbol displays stop moving. The indicated symbols or numbers display to the player an award amount.

36 Claims, 12 Drawing Sheets

U.S. PATENT DOCUMENTS

| | | | | |
|---|---|---|---|---|
| 6,059,658 | A | 5/2000 | Mangano et al. | |
| 6,086,066 | A | 7/2000 | Takeuchi et al. | |
| 6,089,977 | A | 7/2000 | Bennett | |
| 6,089,978 | A | 7/2000 | Adams et al. | |
| 6,105,962 | A | 8/2000 | Malavazos et al. | |
| 6,113,098 | A | 9/2000 | Adams | |
| 6,142,873 | A | 11/2000 | Weiss et al. | |
| 6,142,874 | A | 11/2000 | Kodachi et al. | |
| 6,159,098 | A | 12/2000 | Slomiany et al. | |
| 6,162,121 | A | 12/2000 | Morro et al. | |
| 6,173,955 | B1 | 1/2001 | Perrie et al. | |
| 6,203,429 | B1 | 3/2001 | Demar et al. | |
| D441,031 | S | 4/2001 | Seelig et al. | |
| 6,213,876 | B1 | 4/2001 | Moore, Jr. | |
| 6,220,593 | B1 | 4/2001 | Pierce et al. | |
| 6,224,483 | B1 | 5/2001 | Mayeroff | |
| 6,227,970 | B1 | 5/2001 | Shimizu et al. | |
| D443,313 | S | 6/2001 | Brettschneider | |
| 6,251,013 | B1 | 6/2001 | Bennett | |
| 6,254,481 | B1 | 7/2001 | Jaffe | |
| 6,267,669 | B1 | 7/2001 | Luciano, Jr. et al. | |
| 6,270,411 | B1 | 8/2001 | Gura et al. | |
| 6,302,790 | B1 | 10/2001 | Brossard | |
| 6,305,686 | B1 | 10/2001 | Perrie et al. | |
| 6,315,663 | B1 | 11/2001 | Sakamoto | |
| 6,336,863 | B1 | 1/2002 | Baerlocher et al. | |
| 6,340,158 | B1 | 1/2002 | Pierce et al. | |
| 6,368,216 | B1 | 4/2002 | Hedrick et al. | |
| 6,386,974 | B1 | 5/2002 | Adams | |
| 6,419,579 | B1 | 7/2002 | Bennett et al. | |
| 6,461,241 | B1 | 10/2002 | Webb et al. | |
| D465,531 | S | 11/2002 | Luciano, Jr. et al. | |
| 6,481,713 | B1 | 11/2002 | Perrie et al. | |
| 6,533,660 | B1 | 3/2003 | Seelig et al. | |
| 6,537,152 | B1 | 3/2003 | Seelig et al. | |
| 6,582,307 | B1 | 6/2003 | Webb | |
| 6,609,972 | B1 * | 8/2003 | Seelig et al. | 463/16 |
| 6,712,694 | B1 | 3/2004 | Nordman | |
| 6,758,473 | B1 * | 7/2004 | Seelig et al. | 273/143 R |

FOREIGN PATENT DOCUMENTS

| | | |
|---|---|---|
| GB | 912685 | 12/1962 |
| GB | 2 201 821 | 9/1988 |
| GB | 2 287 567 | 9/1995 |
| GB | 2 383 668 | 7/2003 |

OTHER PUBLICATIONS

4DU Dice Unit Advertisement written by starpoint.uk.com, printed on Sep. 3, 2002.
American Bandstand Brochure written by Anchor Games, published in 2001.
Big Shot!™ Advertisement published by Aristocrat Technologies, Inc., published in 2002.
Big Top Keno Advertisement published by Aristocrat Technologies, Inc., published in 2000.
Bonus Roulette Brochure written by F. Franco, not dated.
Buck's Roulette Brochure written by R. Franco, not dated.
Chariot's of Fortune Brochure written by R. Franco, not dated.
Classic Pot of Gold Brochure written by Ace Coin Equipment Ltd., not dated.
Cyberdyne Gaming Brochure written by Cyberdyne Gaming, not dated.
Elvira® Mistress of the Dark™ Advertisement written by IGT, published in 2002.
Elvis Hits Advertisement written by IGT, published in 1999.
Holy Smoke Brochure written by Impulse Gaming Ltd., not dated.
Jack and the Beanstalk™ Brochure written by AC Coin & Slot, not dated.
King of the Grill™ Brochure written by AC Coin & Slot, not dated.
Line-Up Brochure written by AC Coin & Slot, not dated.
Little Green Men Jr.™ Advertisement written by AC Coin & Slot, not dated.
Little Green Men Jr.™ Article written by Strictly Slots, published in Feb. 2003.
Miss America Brochure written by AC Coin & Slot, not dated.
Mix and Match Article written by Strictly Slots, published in Apr. 2002.
Mix and Match Advertisement published by AC Coin & Slot, not dated.
Money Grab Article written by Strictly Slots, published in Apr. 2001.
Monster Match Article written by Strictly Slots, published in Jan. 2002.
On The Money! Article written by Strictly Slots, published in Dec. 2000.
Payout!™ Advertisement written by www.csds.com/Gaming/Products/g_Payout.htm, printed on Jan. 15, 2001.
Payout!™ Article written by Casino Data Systems, not dated.
Pick a Prize Brochure written by Acres Gaming Incorporated, published prior 2001.
Power Slotto Brochure published by AC Coin & Slot prior to 2002.
Press Your Luck Brochure published by AC Coin & Slot prior to 2002.
Quick Pick Paytime Brochure written by Acres Gaming Incorporated, published prior to 2001.
R&B™ Brochure published by AC Coin & Slot, not dated.
Reel Dice Advertisement written by Gerber & Glass, published in 1936.
Royal Roulette Brochure written by Impulse Gaming Ltd., not dated.
Slot Machine Buyer's Handbook, A Consumer's Guide to Slot Machines written by David L. Saul and Daniel R. Mead, published in 1998.
Silver City Roundup Brochure published by AC Coin & Slot, not dated.
Slot Machines A Pictorial History of the First 100 Years, 5th edition written by Marshall Fey, published in 1983-1997.
Slot Machines on Parade, 1st edition written by Robert N. Geddes and illustrated by Daniel R. Mead, published in 1980.
Spin-A-Lot Brochure written by Acres Gaming Incorporated, published prior to 2001.
Take Your Pick Article written by Strictly Slots, published in Mar. 2001.
Yahtzee Bonus Advertisement written by Mikohn, published in 1999.

* cited by examiner

GAMING DEVICE HAVING INDEPENDENTLY LINEARLY MOVEABLE SYMBOL INDICATORS

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

DESCRIPTION

The present invention relates in general to a gaming device, and more particularly to a wagering gaming device having independently linearly moveable symbol indicators.

BACKGROUND OF THE INVENTION

Gaming device manufacturers strive to make gaming devices that provide as much enjoyment, entertainment and excitement as possible to players. Providing interesting and exciting primary and secondary games in which a player has an opportunity to win potentially large awards or credits is one way to enhance player enjoyment and excitement. Another way to enhance a player's enjoyment, entertainment and excitement with a gaming device is by including lights, sounds and other visual or audio or audio-visual effects in the gaming machines.

Some known gaming device use mechanical devices such as reels or wheels to enhance the attraction of wagering gaming machines to players and also to enhance the player's game playing experience. These mechanical devices enable a player to see physical representations of a game or a portion of a game, which increases the player's enjoyment of the game. Similarly, when a player wins an award, known gaming devices provide the award accompanied by lights, sounds, and other visual or audio or audio-visual effects to increase the player's excitement upon receiving an award.

Therefore, to increase player enjoyment and excitement, it is desirable to provide new and different mechanical devices in conjunction with wagering gaming devices that provide awards to a player.

SUMMARY OF THE INVENTION

The present invention provides a wagering gaming device having independently linearly moveable or oscillating symbol indicators. In a preferred embodiment, the gaming device includes a cabinet having a housing connected to the top of the cabinet. The housing supports one or more independently linearly moveable mechanical symbol indicators. Each linearly movable mechanical symbol indicator includes a symbol display with a plurality of symbols such as numbers displayed in substantially linear alignment along its length. The housing also includes an indicator member that indicates to a player which symbols or numbers to read on one or more of the symbol displays. The symbol displays are linearly movable within the housing such that the symbols or numbers marked by the indicator members change according to the movement of the symbol displays.

In one embodiment where the symbols are numbers, the symbol displays each independently oscillate or move back and forth before stopping and displaying the award amount.

The movement of the symbol displays increase player excitement as the different possible awards are indicated to the player.

In another embodiment, the symbol displays linearly moves or oscillates while a game is not being played. In this case, the gaming device is in an attract mode wherein the moving symbol displays help to attract player interest in the game.

In another embodiment, the movement of the symbol displays indicate the beginning of a bonus round, game or game event. The random movement of the symbol displays increases the excitement and enjoyment during the occurrence of a bonus event.

In one embodiment, the indicator member includes a mask extending substantially horizontally across the housing through which a symbol such as a number on the substantially vertically extending and moveable symbol display may be read by a player. In other embodiments, several indicator members mark the symbols such as numbers or digits of or that indicate an award amount to be provided to the player. The indicator members in these embodiments may be movable and/or may be illuminated to convey information about the number or symbol marked or indicated.

It should be appreciated that the symbol display can display any suitable images, symbols or indicia such as bells, hearts, fruits, numbers, letters, bars or other images or symbols which preferably correspond to a theme associated with the gaming device.

In one embodiment, the numbers indicated on the symbol displays are the individual digits of an award amount to be awarded to the player. In another embodiment, the numbers indicated are added to obtain the amount to be awarded to the player. In another embodiment, one or more numbers indicate the award and one or more numbers indicate one or more modifiers such as multipliers to be applied to the award to determine a total award amount.

The mechanical symbol indicators can be activated in any of a number of situations during game play. In one embodiment, upon the occurrence of an event that triggers a variable award, the mechanical symbol indicators can display the award amount. Similarly, in another embodiment, a variable award can be won in a bonus game environment where the linearly moving mechanical symbol indicators display the award amount.

In another embodiment, the award amount is determined by a processor prior to or during the activation of the mechanical symbol indicators. In this case, the mechanical symbol indicators function as an award display, showing the award amount as determined by the processor to the player in an entertaining and enjoyable fashion. Further, certain embodiments of the present invention include a position sensor that provides data on the position of the symbol display to the processor of the gaming device.

In another embodiment, the award amount provided to the player is randomly determined based on probabilities associated with each of the symbols on the symbol display. The processor moves and stops the symbol displays randomly based on the probabilities. The numbers or symbols displayed when the symbol displays have stopped are sensed by the position sensors which send signals to the processor to verify the position of the symbol displays. The processor provides an award corresponding to those symbols or numbers displayed to the player.

It is therefore an advantage of the present invention to provide a gaming device having at least one linearly moveable mechanical symbol indicator.

Another advantage of the present invention is to enhance the indication of awards to players.

Still another advantage of the present invention is to increase the attraction of a gaming device.

Additional features and advantages of the present invention are described in, and will be apparent from the following Detailed Description of the Invention and the figures.

DETAILED DESCRIPTION OF THE INVENTION

Gaming Device and Electronics

Figure 1:
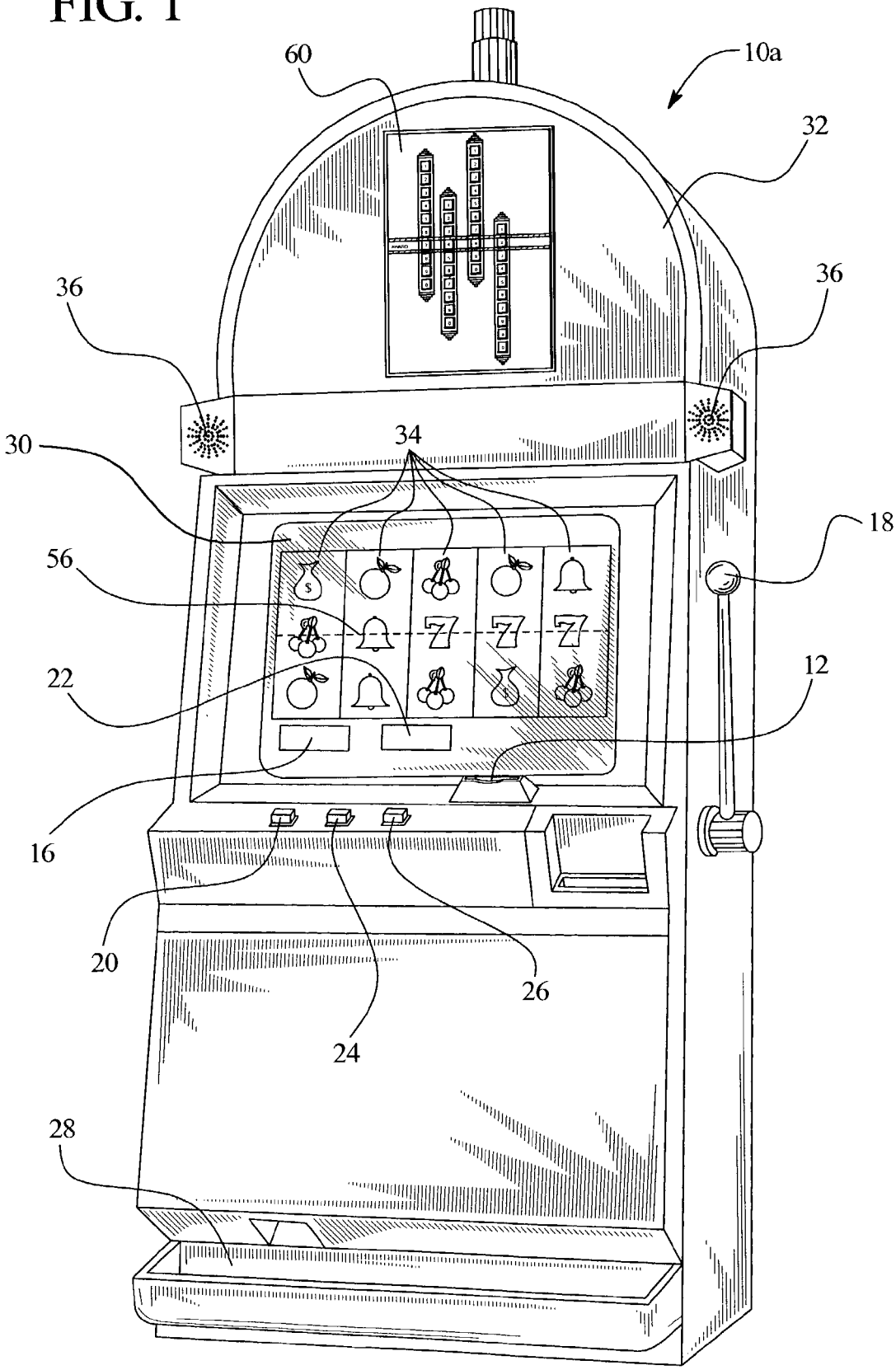
FIG. 1 is a front perspective view of a general embodiment of the gaming device of the present invention.

Referring now to the drawings, one embodiment of the gaming device of the present invention is illustrated in FIG. 1 as gaming device 10. In one embodiment, gaming device 10 is a slot machine having the controls, image panels and features of a conventional slot machine. It is constructed so that a player can operate it while standing or sitting, and gaming device 10 may be mounted in console or cabinet. However, it should be appreciated that gaming device 10 can be constructed as a pub-style table-top game (not shown) which a player can operate preferably while sitting. Furthermore, gaming device 10 can be constructed with varying cabinet and display designs.

Gaming device 10 can incorporate any suitable primary game such as slot, poker, blackjack or keno, any of their bonus triggering events and any of their bonus round games. The symbols and indicia used on and in gaming device 10 may be in mechanical, electrical, electronic or video form.

As illustrated in FIG. 1, gaming device 10 includes a coin slot 12 and bill acceptor 14 where the player inserts money, coins or tokens. The player can place coins in the coin slot 12 or paper money in the bill acceptor 14. Other devices could be used for accepting payment such as readers or validators for credit cards or debit cards. When a player inserts money in gaming device 10, a number of credits corresponding to the amount deposited is shown in a credit display 16. After depositing the appropriate amount of money, a player can begin the game by pulling arm 18 or pushing play button 20. Play button 20 can be any play activator used by the player which starts any game or sequence of events in the gaming device.

Gaming device 10 also includes a bet display 22 and a bet one button 24, as shown in FIG. 1. The player places a bet by pushing the bet one button 24. The player can increase the bet by one credit each time the player pushes the bet one button 24. When the player pushes the bet one button 24, the number of credits shown in the credit display 16 decreases by one, and the number of credits shown in the bet display 22 increases by one. The gaming device 10 can include other wager indicators such as a bet max button.

A player may cash out and thereby receive a number of coins corresponding to the number of remaining credits by pushing a cash out button 26. When the player cashes out, the player receives the coins in a coin payout tray 28. The gaming device 10 may employ other payout mechanisms such as credit slips redeemable by a cashier or electronically recordable cards which keep track of the player's credits.

Gaming device 10 also includes one or more display devices. The embodiment shown in FIG. 1 includes a central display device 30 and a housing 32 with a front panel 60 supporting at least one mechanical symbol indicator and, preferably a plurality of mechanical symbol indicators 70. In the illustrated embodiment, gaming device 10 displays a plurality of reels such as five reels 34 in mechanical or video form in the display device 30. A display device can be any suitable viewing surface such as glass, a video monitor or screen, a liquid crystal display or any other display mechanism or apparatus. If the reels 34 are in video form, the display device for the video reels 34 is preferably a video monitor. Each reel 34 displays a plurality of indicia such as bells, hearts, fruits, numbers, letters, bars or other images which preferably correspond to a theme associated with the gaming device 10. Furthermore, gaming device 10 preferably includes speakers 36 for making sounds or playing music.

Figure 2:
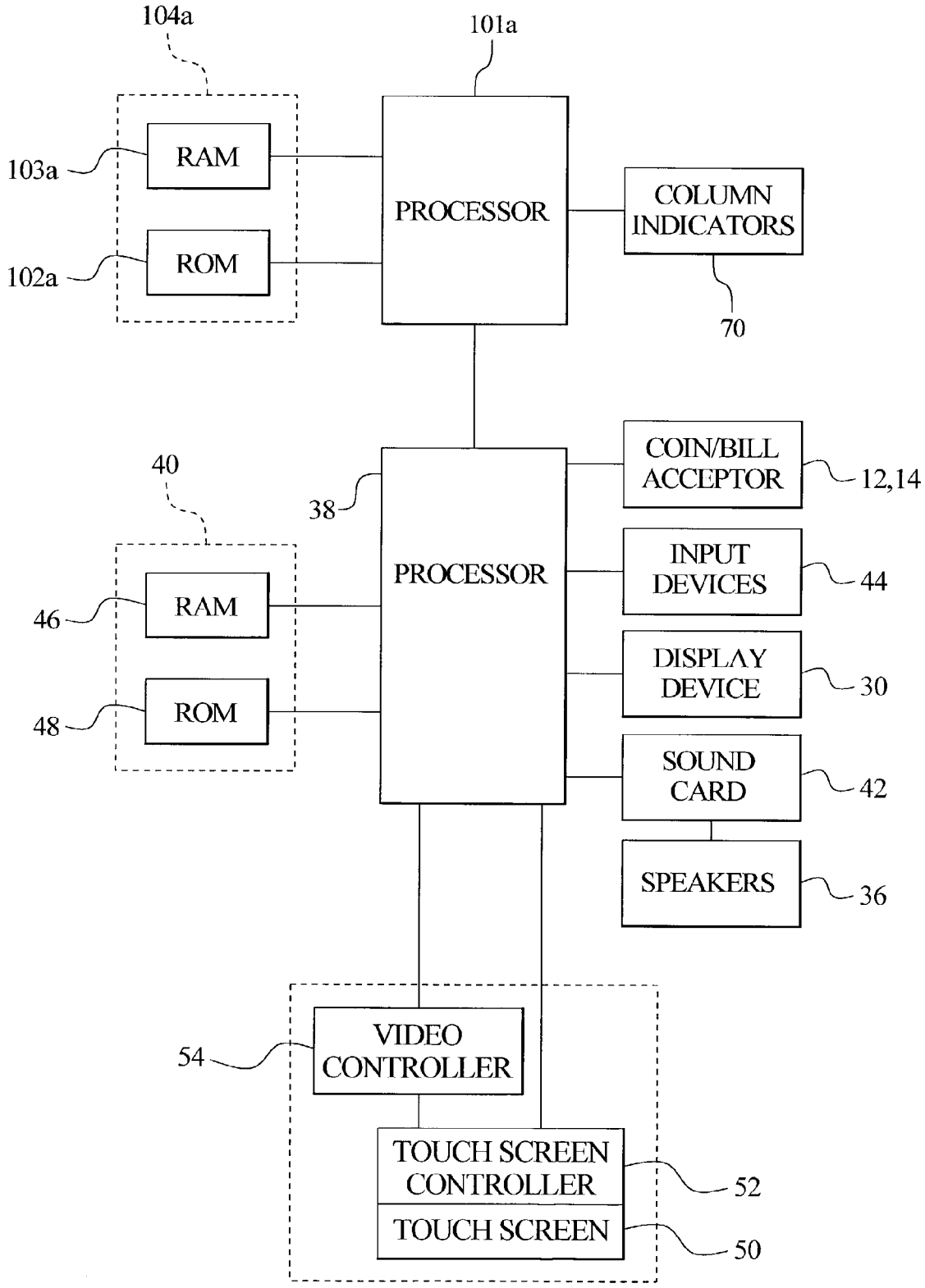
FIG. 2 is a schematic block diagram of the electronic configuration of one embodiment of the gaming device of the present invention.

As illustrated in FIG. 2, the general electronic configuration of gaming device 10 preferably includes: processors 38 and 101*a*; memory devices 40 and 104*a* for storing program code or other data; a central display device 30; one or more mechanical award indicators 70; a sound card 42; a plurality of speakers 36; and one or more input devices 44. The processor 38 is preferably a microprocessor or microcontroller-based platform which is capable of displaying images, symbols and other indicia such as images of people, characters, places, things and faces of cards. The processor 38 can communicate with a secondary processor 101*a* to operate the mechanical symbol indicators 70 to independently control the movement and position of each symbol display 64. The memory devices 40 and 104*a* can include random access memory (RAM) 46 for storing event data or other data generated or used during a particular game. The memory devices 40 and 104*a* can also include read only memory (ROM) 48 and 102*a* for storing program code which controls the gaming device 10 so that it plays a particular game in accordance with applicable game rules and pay tables.

As illustrated in FIG. 2, the player preferably uses the input devices 44, such as pull arm 18, play button 20, the bet one button 24 and the cash out button 26 to input signals into gaming device 10. In certain instances it is preferable to use a touch screen 50 and an associated touch screen controller 52 instead of a conventional video monitor display device. Touch screen 50 and touch screen controller 52 are connected to a video controller 54 and processor 38. A player can make decisions and input signals into the gaming device 10 by touching touch screen 50 at the appropriate places. As further illustrated in FIG. 2, the processor 38 can be connected to coin slot 12 or bill acceptor 14. The processor 38 can be programmed to require a player to deposit a certain amount of money in order to start the game.

It should be appreciated that although processors 38 and 101*a* and memory devices 40 and 104*a* are preferable implementations of the present invention, the present invention can also be implemented using one or more application-specific integrated circuits (ASIC's) or other hard-wired devices, or using mechanical devices (collectively or alternatively referred to herein as a "processor"). Furthermore, although the processors 38 and 101*a* and memory devices 40 and 104*a* preferably reside on each gaming device 10 unit, it is possible to provide some or all of their functions at a central location such as a network server for communication to a playing station such as over a data network such as a local area network (LAN), wide area network (WAN), Internet connection, microwave link, and the like. The processor 38 and memory device 40 is generally referred to herein as the computer or controller and processor 101 and memory devices 104 is generally referred to herein as the motor controller.

With reference to FIGS. 1 and 2, to operate the gaming device 10 in one embodiment the player must insert the appropriate amount of money or tokens at coin slot 12 or bill acceptor 14 and then pull the arm 18 or push the play button 20. The reels or simulated reels 34 will then begin to spin. Eventually, the reels 34 will come to a stop. As long as the player has credits remaining, the player can spin the reels 34 again. Depending upon where the reels 34 stop, the player may or may not win additional credits, and gaming device 10 may or may not activate the mechanical award indicators 70 to display an award amount to the player.

In addition to winning credits in this manner, preferably gaming device 10 also gives players the opportunity to win credits in a bonus round or bonus game. This type of gaming device 10 will include a program which will automatically begin a bonus round when the player has achieved a qualifying condition in the game. This qualifying condition can be a particular arrangement of indicia on a display device. The gaming device 10 preferably uses a video-based central display device 30 to enable the player to play the bonus round or bonus game. In one embodiment, the qualifying condition is a predetermined combination of indicia appearing on a plurality of reels 34. As illustrated in the five reel slot game shown in FIG. 1, the qualifying condition could be the number seven appearing on three adjacent reels 34 along a pay line 56. It should be appreciated that the present invention can include one or more pay lines 56 displayed in a horizontal and/or diagonal fashion.

Mechanical Symbol Indicators

In a preferred embodiment, gaming device 10 enables the player to win an initially undetermined or undisplayed award. Winning the award can occur either in a primary or base game or a secondary or bonus game. To increase the player's excitement, the amount of the variable award to be provided to the player can be displayed using one and preferably a plurality of independently linearly moveable or oscillating mechanical symbol indicators 70. The mechanical symbol indicators 70 each independently linearly move symbol displays 64 in a substantially vertical manner in one direction or in a plurality of directions (i.e., oscillating up and down) or in a substantially horizontal manner in one direction or in a plurality of directions (i.e., oscillating side to side). Together with one or more indicator members 62, the symbol displays 64 in one embodiment display various symbols such as award values before stopping to display the final symbols or award amount to be provided to the player. In one preferred embodiment, the indicated numbers are the individual digits of the award amount.

With reference to FIGS. 3A through 5B, the mechanical symbol indicators 70 are supported in a housing 32 that is preferably connected to the cabinet of gaming device 10. The mechanical symbol indicators 70 each have a symbol display 64 that is linearly movable or which oscillates within housing 32. The housing 32 also includes at least one indicator member 62 that indicates which of a plurality of symbols or numbers 66 displayed on each symbol display 64 are to be read by the player to determine the award amount to be provided to the player. The indicator member 62 may be supported by the housing 32 or the front panel 60. Additionally, the indicator member 62 can be positioned on the extension of the housing 32. In an alternative embodiment, one or more symbol displays 64 linearly move out of the top or a side of the housing 32 (or cabinet) to indicate symbol(s) such as an award. In such an embodiment, a suitable award indicator may be provided at the top or side of the housing or cabinet.

In one embodiment, the front panel 60 of the housing 32 is transparent or semi-transparent to enable a player to view the moving symbol displays 64, as illustrated in FIGS. 3A through 3C, 5A and 5B which also illustrate certain of the various positions of the symbol displays. It should be appreciated that all of the symbol displays can move simultaneously in the same or different directions, sequentially or in any suitable manner desired by the gaming machine implementator. In these embodiments, the player can also view images in the housing 32 associated with the theme of gaming device 10 and possibly other components of the mechanical symbol indicators 70 in addition to the symbol displays 64 and indicator members 62. The front panel 60 can alternatively be opaque such that only the number 66 indicated by the indicator member 62 is visible to the player as generally illustrated in FIG. 4. In this embodiment, the player can watch the numbers change as the symbol displays 64 move in relation to the housing 32.

The indicator member 62 can be embodied in several alternative ways as shown in FIGS. 3A through 3C, 4, 5A and 5B. As illustrated in 3C, the indicator member 62 can be a mask extending across the symbol displays 64 that mark one or more symbols such as numbers 66 on each symbol display 64 to be read by the player. In this embodiment, the front panel 60 is transparent or semi-transparent such that the player can view the symbol displays 64 in the housing 32. In another embodiment illustrated in FIG. 4, the indicator member 62 is a mask that shows only the symbol such as number 66 to be viewed by the player on each symbol display 64. In this embodiment, the front panel 60 is opaque such that the player cannot see inside the housing 32. It should be appreciated that the alternative embodiments of indicator member 62 can be supported by the housing 32, supported by the front panel 60, incorporated into front panel 60, supported by any part of the mechanical award indicators 70 or positioned in any other suitable manner to indicate which symbols such as numbers for the player to read. It also should be appreciated that the indicator member 62 may alternatively be movable in relation to the housing 32.

Figure 5A:
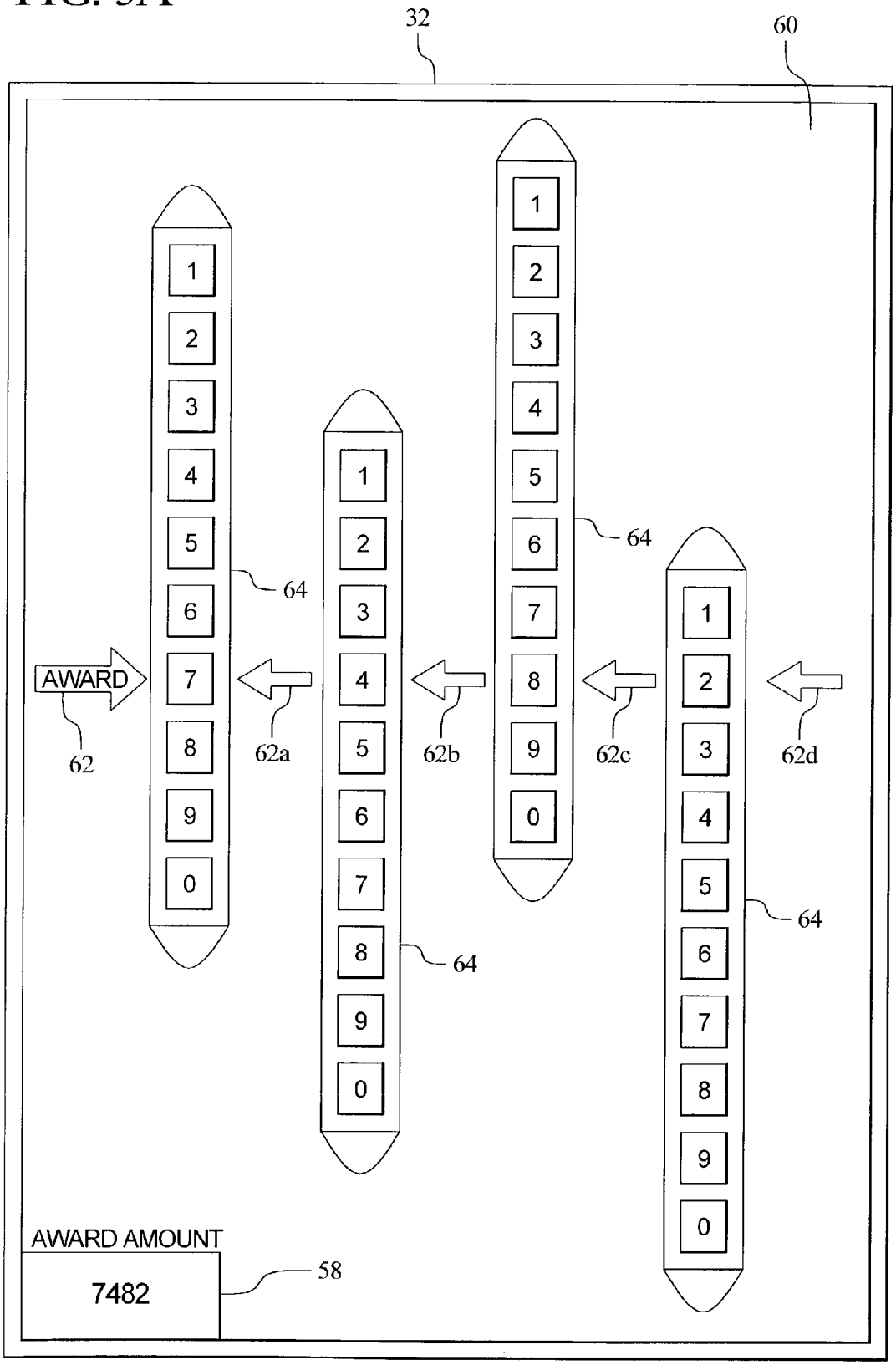
FIGS. 5A and 5B are front plan views of the housing showing different embodiments of the indicator members of the present invention.
Figure 5B:
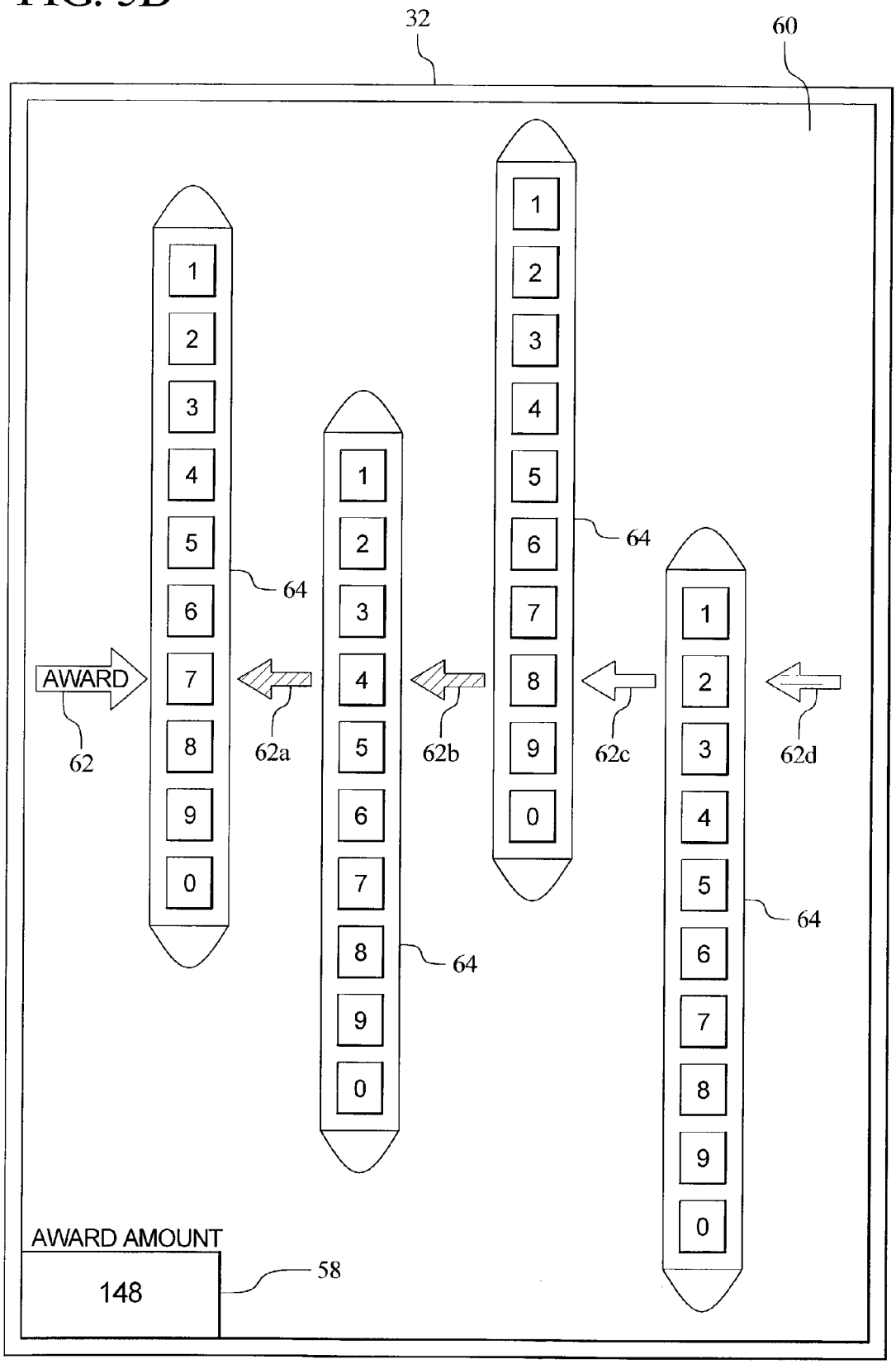
Figure 6:
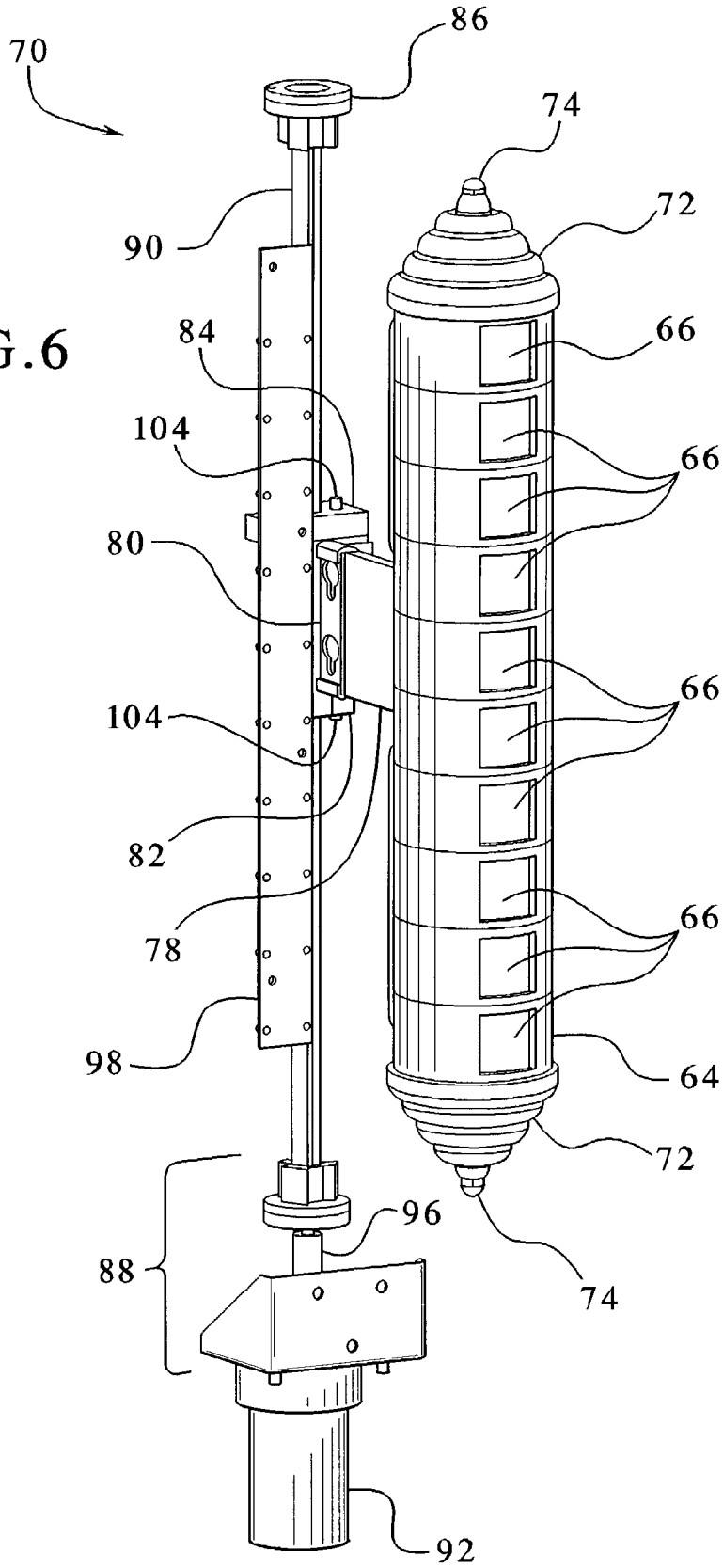
FIG. 6 is a front perspective view of one embodiment of the mechanical symbol indicator of the present invention removed form the housing.
Figure 7:
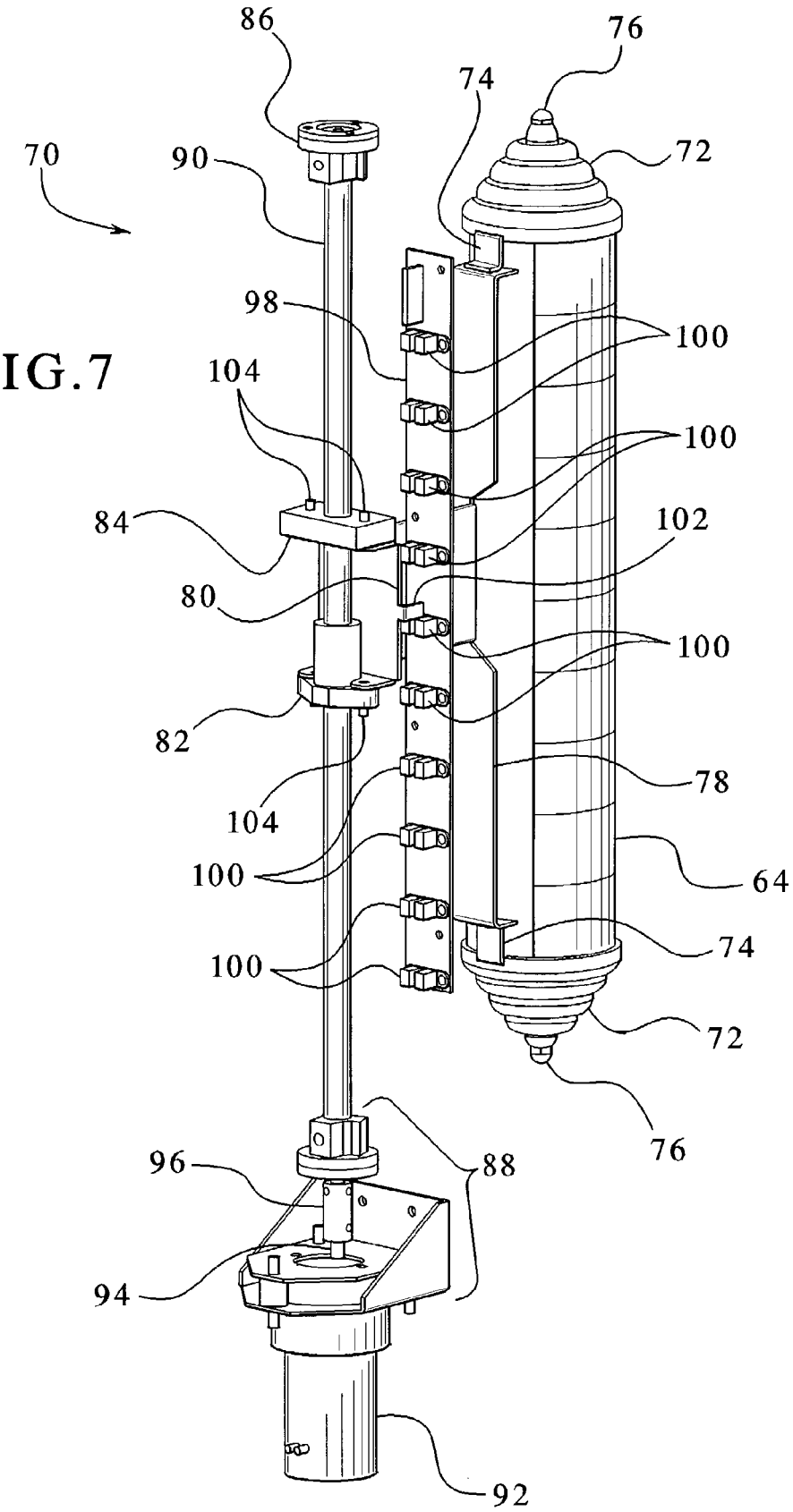
FIG. 7 is a rear perspective view of the embodiment of the mechanical symbol indicator of FIG. 6.
Figure 8:
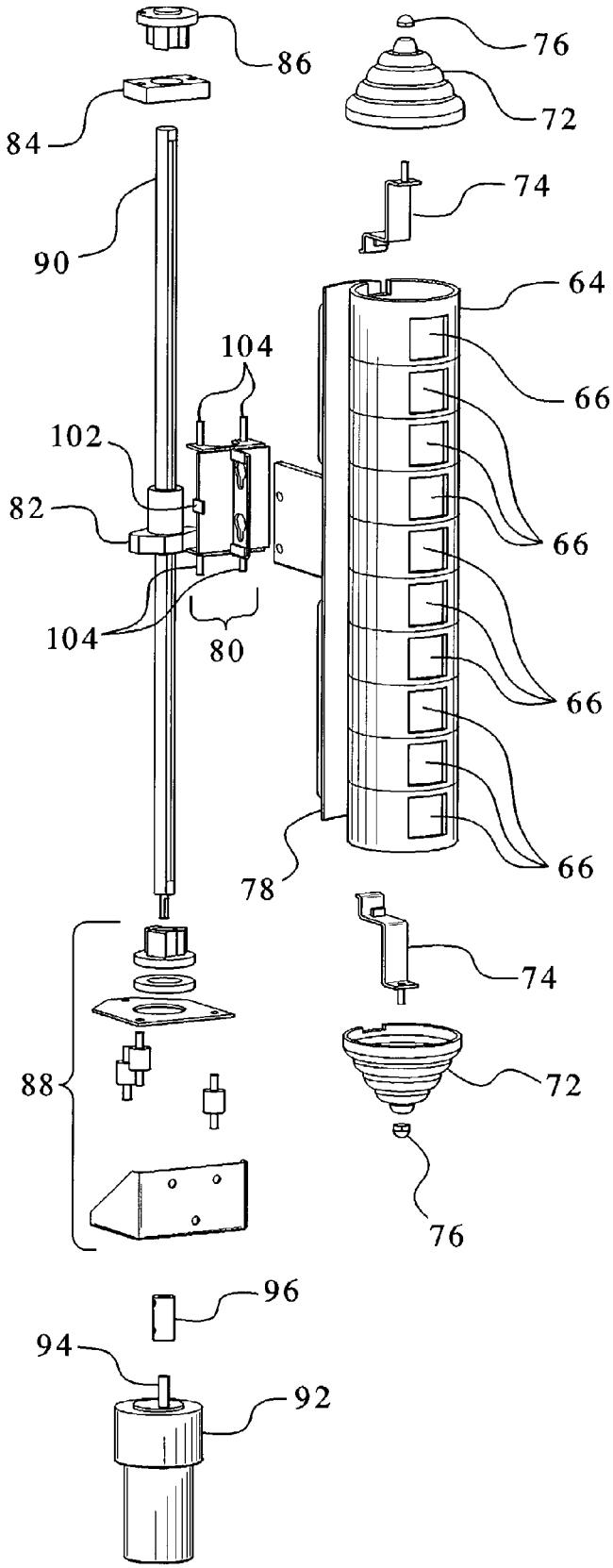
FIG. 8 is an exploded front perspective view of the embodiment of the mechanical symbol indicator of FIG. 6.
Figure 9:
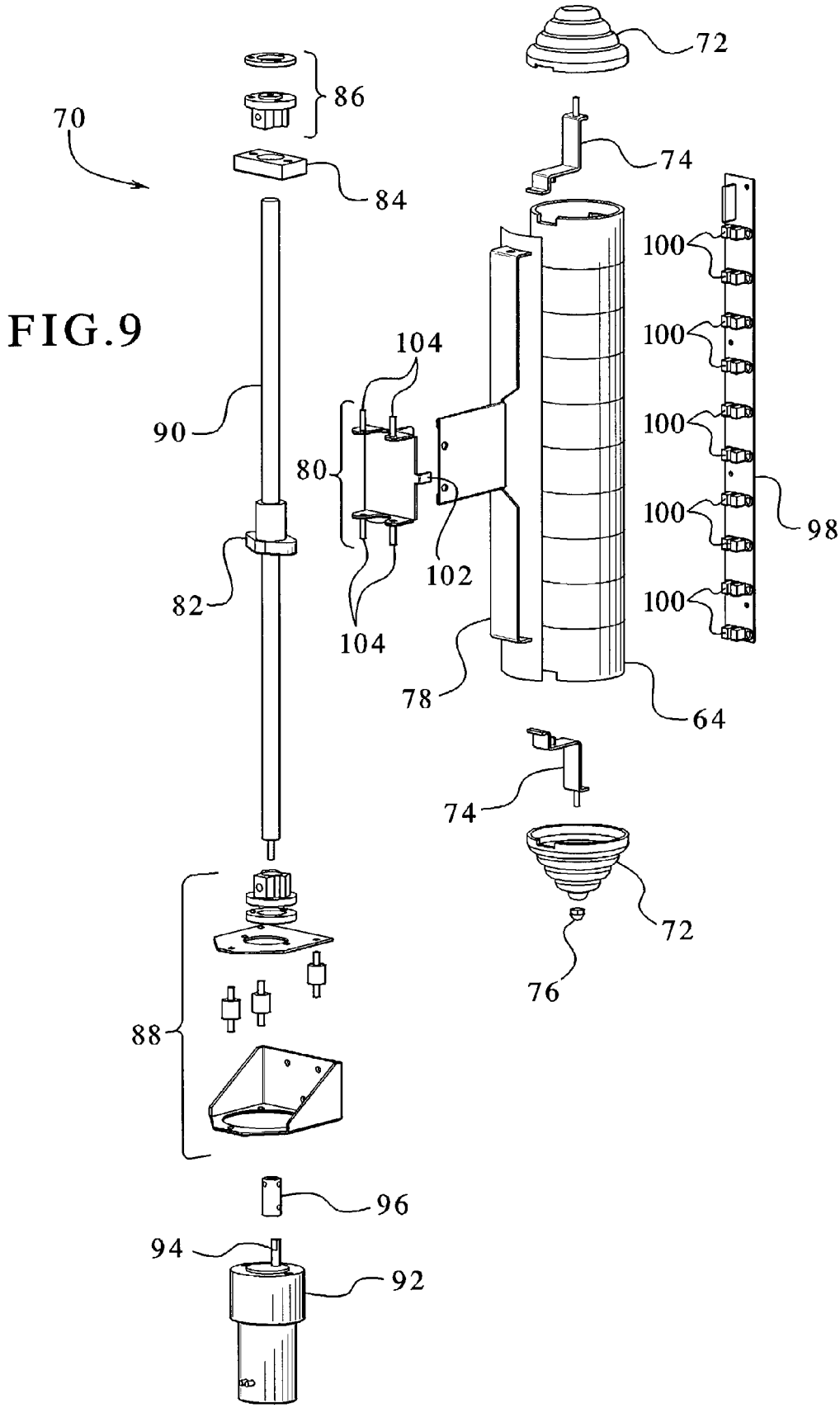
FIG. 9 is an exploded rear perspective view of the embodiment of the mechanical award indicator of FIG. 6.

In other embodiments illustrated in FIGS. 5A and 5B, the indicator member 62 includes several members 62*a* through 62*d* that indicate or point out the particular symbols or numbers to read on each symbol display 64. The members 62*a* through 62*d* can include arrows as illustrated in FIGS.

5A and 5B or other shapes or indicia that mark which symbols or numbers to read. Further, the indicators may include one or more lights that indicate certain symbol displays 64 are to be read or that certain symbols or numbers have a different meaning as illustrated in the example in FIG. 5B. In this example, after symbol displays 64 have stopped moving, indicator member 62*d* lights up in one color to indicate that number is a multiplier to be applied to the numbers indicated by indicator members 62*a* and 62*b* that are lit in another color. Indicator member 62*c* is not illuminated, which indicates that symbol display does not factor into the award amount. In this example, the award amount to be provided to the player would be seventy-four multiplied by two or one hundred forty-eight. Alternatively, the indicator members 62 may be lights next to or on the symbol displays 64 or other parts of the mechanical award indicators 70. In this or any of the other embodiments, a total award amount display 58 may or may not be included to display to the player the final award amount to be provided to the player. Accordingly, it should be appreciated that the mechanical symbol indicators could be employed in a variety of manners to indicate awards to players.

In one embodiment, each mechanical symbol indicator 70 includes a symbol display 64, a support assembly, and an actuator 92. The symbol display 64 is supported by the support assembly. The support assembly and the actuator 92 are supported by or suitably mounted in the housing 32. The processor 101*a* controls the actuator 92 that co-acts with the support assembly to move the symbol display 62 linearly within the housing 32.

With reference to FIGS. 6 through 9, a preferred embodiment of a mechanical symbol indicator 70 includes the components supported by or mounted in the housing 32. More specifically, the symbol display 64 includes a cylindrical tube with areas, positions or places 66 to display a plurality of symbols such as numbers along the length of the tube. An end cap support bracket 74 and end cap fastener 76 rigidly attach decorative end caps 72 on either end of the symbol display 64. The symbol display 64 is also rigidly attached to a support member 78. The support member 78 is rigidly fastened using suitable fasteners such as bolts to a support bracket 80.

The support bracket 80 is rigidly attached to the support assembly within the housing 32. In the preferred embodiment, the support assembly includes a lead screw assembly. Lead screw assemblies including the nut assembly 82, support brace 84, rod support 86, actuator support 88, and rod 90 can be commercially purchased for example from Kerk Motion Products, Inc. The support bracket 80 is rigidly connected to the lead screw assembly via a lead screw nut assembly 82 and a slidably movable support brace 84. The support bracket 80 has posts 104 that mate with the lead screw nut assembly 82 and slidably movable support brace 84 to securely hold the support bracket 80, support member 78, and symbol display 64.

The lead screw assembly is controlled by the processor 101*a* which causes the lead screw nut assembly 82 and any components rigidly connected to the lead screw nut assembly 82 to move in a linear direction along a lead screw assembly rod 90 within the housing 32. It should be appreciated that any other suitable assembly or actuator such as a movable track, movable belt, chain and gear system or other equivalent system or assembly adapted to linearly move the symbol display 64 within the housing 32 can be used in conjunction with the present invention.

In the preferred embodiment, the lead screw assembly is powered by a motor 92. The motor's crankshaft 94 is connected to the lead screw assembly via a coupling to the screw motor connector 96 and lead screw assembly motor support 88. The motor 92 is operable with processor 101*a* to power the lead screw assembly and move the symbol display 64. It should be appreciated that this embodiment of the mechanical award indicator 70 can be supported within housing 32 through the lead screw assembly motor support 88 and/or a lead screw assembly rod support 86.

A preferred embodiment of a mechanical symbol indicator 70 also includes a position sensor. The position sensor includes a position indicator or blocking tab 102 and position detector or position detector member 98. The position indicator or blocking tab 102 is rigidly attached to the symbol display 64 such that the position indicator or blocking tab 102 moves with the symbol display 64 inside or outside of the housing 32. The position detector member 98 is rigidly mounted or supported by the housing 32 or other structure such that the detector member 98 reasons stationery in respect to the housing 32. As the position indicator or blocking tab 102 moves with the symbol display 64, the detector member 98 sends a signal to the processor 101*a* indicating where the symbol display 64 is relative to the housing 32.

One preferred embodiment of the position sensor used in conjunction with the present invention includes a position sensor board 98 that is rigidly attached to the housing 32, a plurality of detecting optical sensors 100, and a position indicator or blocking tab 102 as illustrated in FIGS. 6 through 9. The position indicator or blocking tab 102 is rigidly connected to support bracket 80 and moves with the symbol display 64 within the housing 32. Each detecting optical sensor or sensor clips 100 is positioned on the sensor board 98 such that when the position indicator or blocking tab 102 passes by or through a detecting optical sensor or sensor clips 100, a signal is sent to the processor 101*a* indicating the position of the symbol display 64. In one embodiment, this position signal may also indicate to the processor 101*a* that a particular number 66 is highlighted to the player by indicator member 62.

Figure 3A:
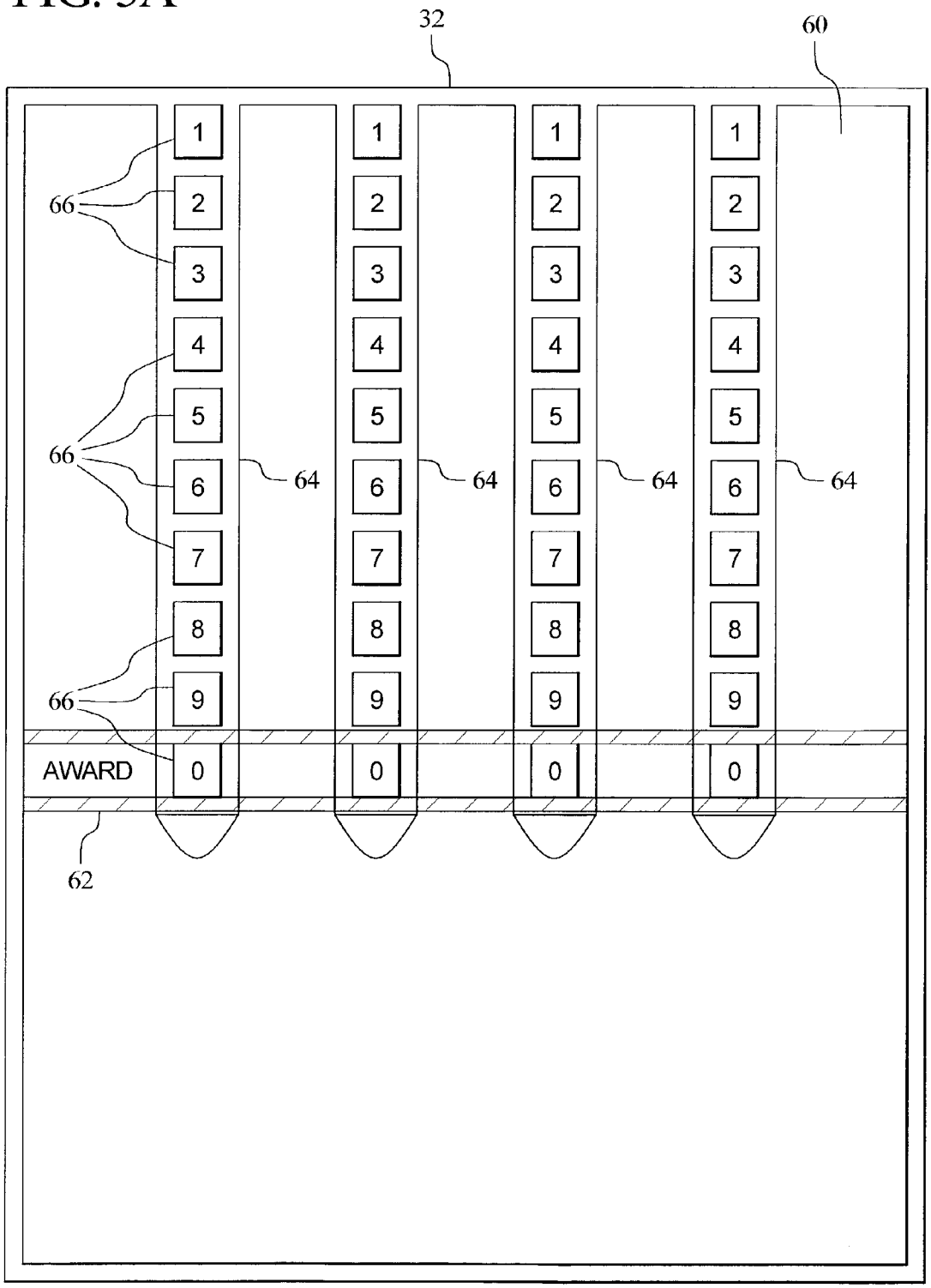
FIGS. 3A through 3C are enlarged front plan views of the housing containing the mechanical symbol indicators and showing the independent linear movement of the mechanical symbol indicators.
Figure 3B:
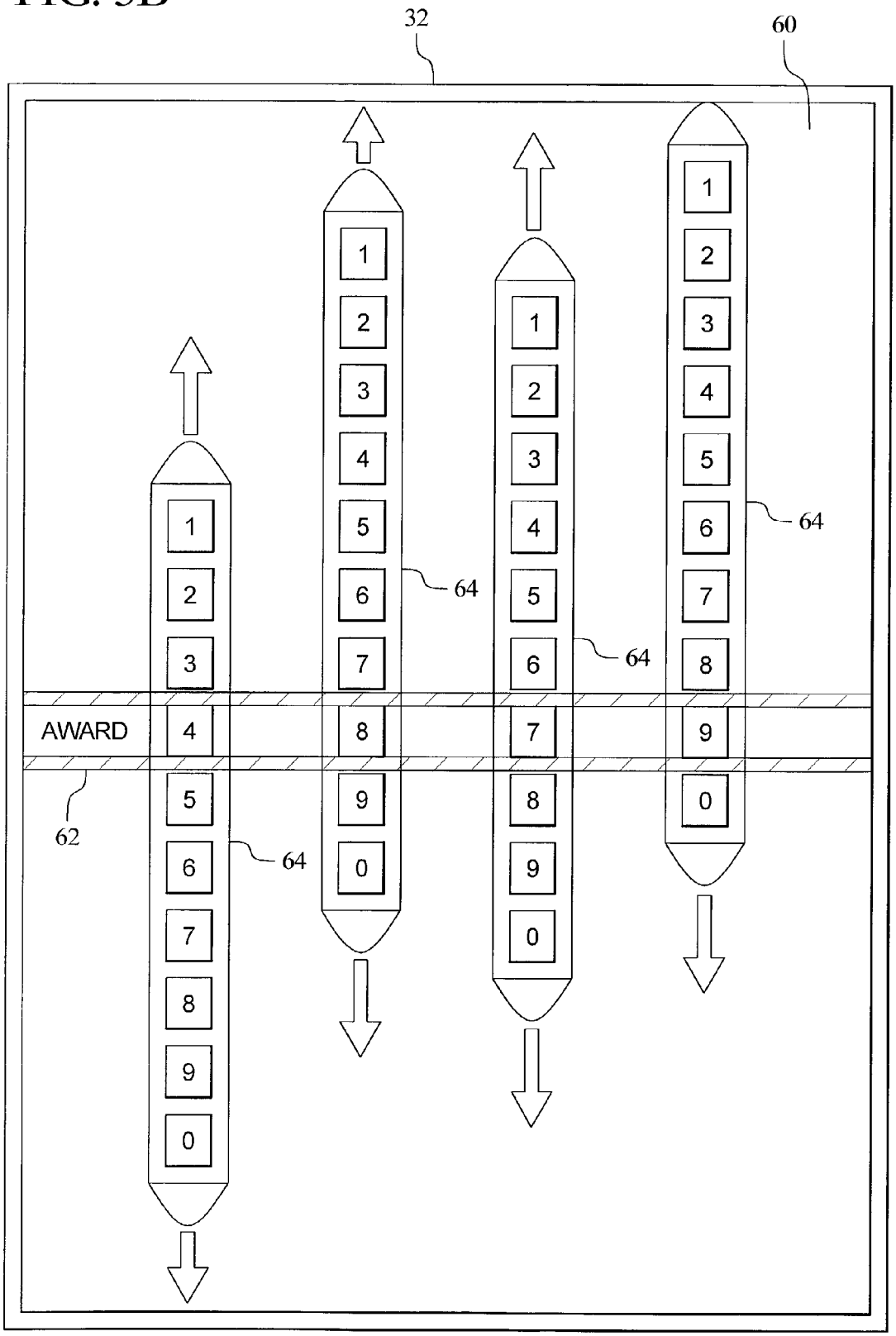
Figure 3C:
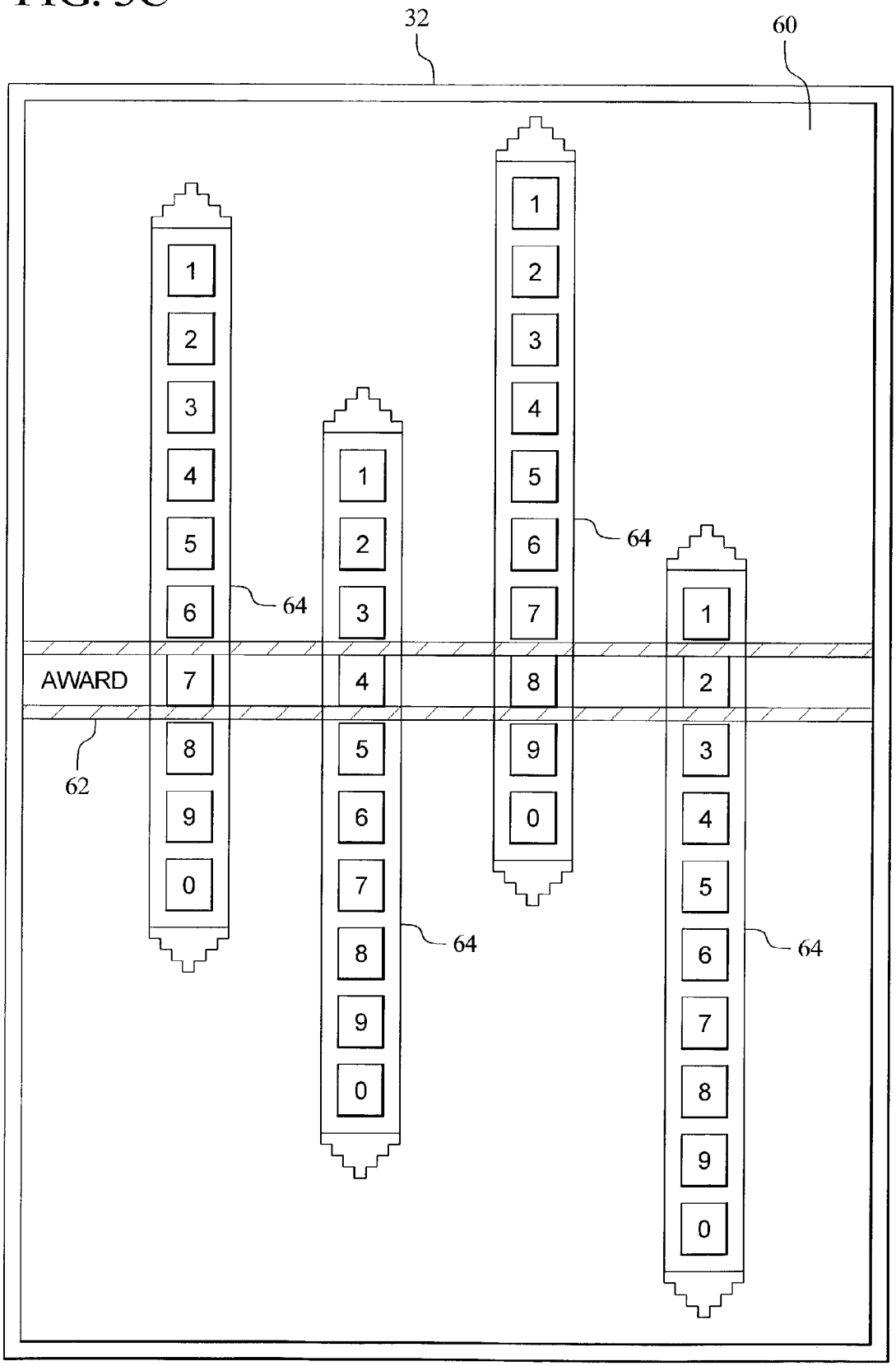
Figure 4:
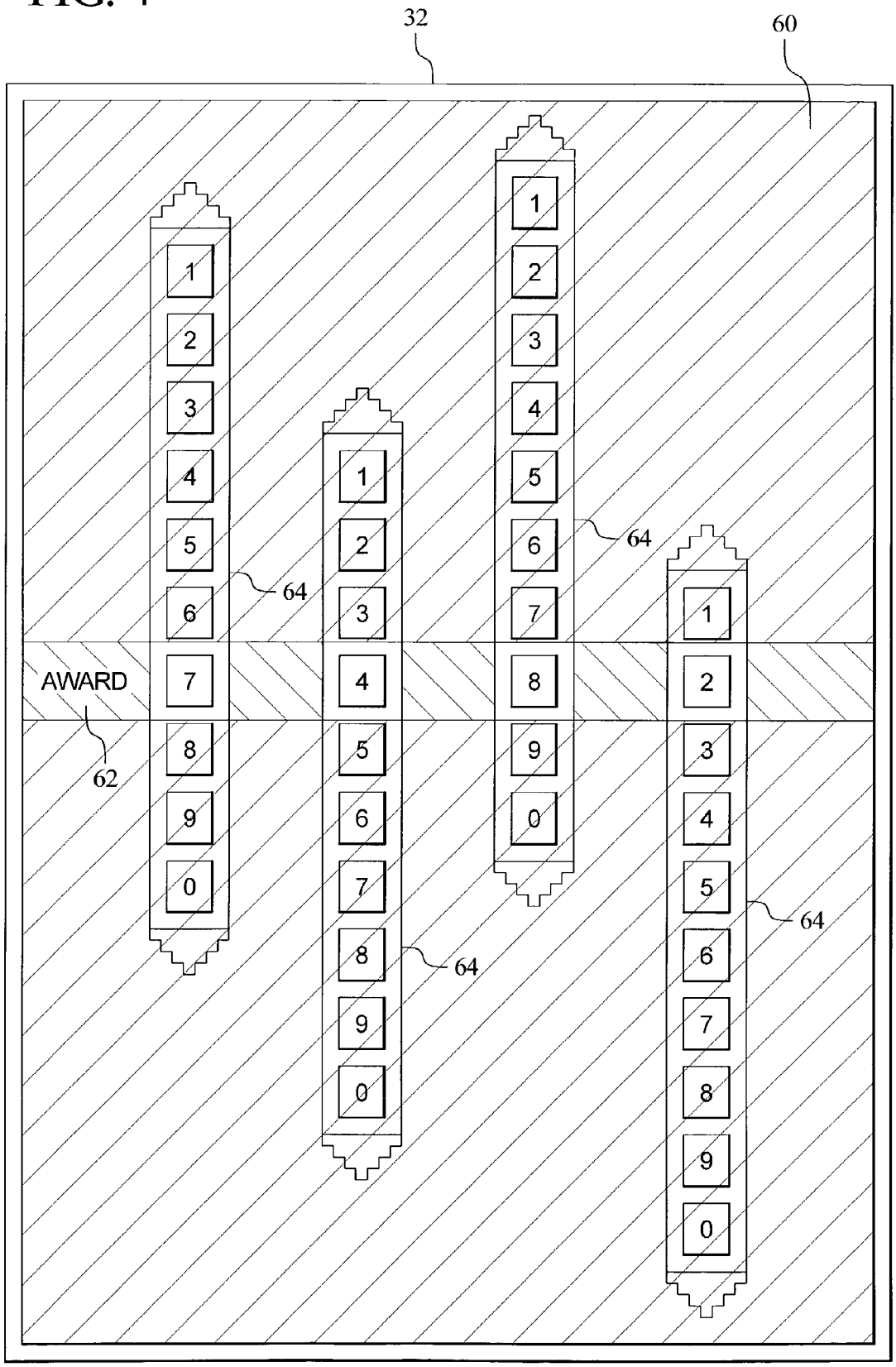
FIG. 4 is a front plan view of one alternative embodiment of the present invention.

A preferred embodiment of the present invention operates as illustrated in FIGS. 3A through 3C. Upon a triggering event in a primary or bonus game, an undetermined or determined but undisplayed award amount is to be provided to the player. Prior to winning the award, the symbol displays 64 together with indicator member 62 can display a zero award amount as shown in FIG. 3A or any other amount. Processor 38 determines the award amount to be provided and communicates to processor 101*a* to activate the linear movement of the symbol displays 64 as illustrated in FIG. 3B. Other effects such as audio, visual, or audio-visual effects may or may not be used in conjunction with the random movement of the symbol displays 64 to further enhance player excitement and anticipation of the award. Finally, the processor 101*a* operable with the mechanical award indicators 70 including the position sensors and actuators, simultaneously or sequentially stop the movement of the symbol displays 64 in the appropriate positions to display the award amount to be provided. With the indicator member 62, the amount of the award to be provided to the player is displayed, 7482 credits as shown in FIG. 3C. It should be appreciated that each of the symbol displays could be moved for the same amount of time, different amounts of time or randomly determined amounts of time and in the same or different directions.

In other embodiments, the numbers displayed can be added to determine the award amount to be provided, or one mechanical symbol indicator 70 can indicate a multiplier to be applied to the number displayed by other mechanical symbol indicators 70 as illustrated above in FIG. 5B. It should be appreciated that the symbols or numbers displayed by the mechanical symbol indicators 70 of the present invention can be combined in other ways to determine and display the symbols or the award amount to be provided to a player.

In another embodiment, the processor 38 does not determine the award amount prior to activating the mechanical award indicators 70. In this embodiment, upon the occurrence of a triggering event to provide the player an undetermined award amount, processor 101*a* automatically begins a random movement of each of the symbol displays 64. After a period of time the processor 101*a* randomly stops each of the symbol displays 64 in one of the positions. The processor 101*a* in conjunction with the position sensor then determines the symbols or award amount to provide to the player from the numbers or symbols displayed to the player. It should be appreciated that the processor 38 can be programmed such that in this embodiment, certain symbols or numbers are weighted differently and thus more likely to be indicated on the symbol displays 64 than others.

In another embodiment, the mechanical symbol indicators 70 are activated when a game is not being played on gaming device 10. In this situation, the symbol displays 64 move randomly within (or outside of the housing 32) and with the indicator members 62 display various symbols or award amounts possible during game play. This embodiment is activated by processor 38 when gaming device 10 is in an attract mode. The motion of the symbol displays 64 and the indication of different awards during the attract mode can help capture a player's attention and make the gaming device 10 more likely to be played.

In a further embodiment, the mechanical symbol indicators 70 are activated during game play to signal certain occurrences. For example, movement of the symbol displays 64 and/or the display of certain symbols can accompany the occurrence of the start of a bonus round or game or entry into a bonus mode for gaming device 10. Further, the mechanical symbol indicators 70 can be used to indicate the start of or occurrence of an event within game play.

It should be appreciated that the present invention could thus be employed in a variety of different manners in conjunction with gaming devices such as to display an award, a series of symbols, an offer in an offer acceptance game or any other suitable game function.

In one embodiment, probabilities or different probabilities can be associated with each of the symbols on each of the symbol displays. These probabilities can be weighted such that certain symbols are more likely to be randomly generated than other symbols. For instance, higher numbers can have lower associated probabilities.

While the present invention is described in connection with what is presently considered to be the most practical and preferred embodiments, it should be appreciated that the invention is not limited to the disclosed embodiments, and is intended to cover various modifications and equivalent arrangements included within the spirit and scope of the claims. Modifications and variations in the present invention may be made without departing from the novel aspects of the invention as defined in the claims, and this application is limited only by the scope of the claims.

The invention is claimed as follows:

1. A gaming device comprising:

a cabinet;

a housing connected to the cabinet;

a plurality of independent mechanical symbol indicators mounted in the housing, the independent mechanical symbol indicators each including a symbol display linearly movable back and forth within the housing, a plurality of symbols on the symbol displays, wherein the symbol displays are linearly movable to display an award to a player;

at least one indicator member connected to the housing to indicate one of the plurality of symbols of the symbol displays; and a processor which controls the mechanical symbol indicators.

2. The gaming device of claim 1, wherein the plurality of symbols includes a plurality of numbers.

3. The gaming device of claim 1, wherein the plurality of symbols includes a plurality of numerical digits.

4. The gaming device of claim 1, wherein the indicator member includes a structure selected from the group consisting of: (a) a fixed mask across a front panel of the housing which defines at least one opening; (b) a fixed indicator positioned to indicate one of the symbols on at least one of the symbol displays; (c) an illuminable indicator; and (d) an opaque front panel of the housing which includes at least one see-through area.

5. The gaming device of claim 1, wherein the symbol displays of the independent mechanical symbol indicators are mounted to move in a vertical linear direction.

6. The gaming device of claim 1, wherein the independent mechanical symbol indicators each include a lead screw assembly coupled with a motor controlled by the processor to linearly move the symbol displays within the housing.

7. The gaming device of claim 1, wherein the independent mechanical symbol indicators include a position sensor in communication with the processor.

8. The gaming device of claim 7, wherein the position sensors include a position indicator and a position detector.

9. The gaming device of claim 1, wherein the symbol displays include a tube and a support member rigidly attached to the tube.

10. A gaming device comprising:

a cabinet;

a housing connected to the cabinet;

a symbol indicator including a support assembly connected to the housing, a plurality of linearly movable symbol independent displays attached to the support assembly, a plurality of symbols displayed by each of the symbol displays, at least one indicator member connected to the housing, a position sensor connected to the housing, and an actuator connected to the symbol displays; and a processor operable with the support assembly, position sensor and actuator to linearly move the symbol displays back and forth at least partially within the housing and stop the symbol displays in a linear position where one of the symbols on at least one of the symbol displays is indicated by the indicator member.

11. The gaming device of claim 10, wherein the support assembly includes a lead screw assembly and a lead screw assembly motor support that connects the lead screw assembly to a motor.

12. The gaming device of claim 10, which includes an end cap rigidly attached to each end of the symbol display by an end cap support bracket and an end cap fastener, a support member attached to the symbol display that fastens to a support bracket, the support bracket attached to the support assembly.

13. The gaming device of claim 10, wherein the indicator member includes a front panel of the housing defining a see-through area.

14. The gaming device of claim 10, wherein the plurality of symbols includes a plurality of numbers.

15. The gaming device of claim 10, wherein the plurality of symbols includes a plurality of numerical digits.

16. The gaming device of claim 10, wherein the symbol display linearly moves to display an award to a player.

17. The gaming device of claim 10, wherein the position sensor includes a position indicator and a position detector.

18. A gaming device comprising:

a cabinet;

a housing connected to the cabinet;

a plurality of independent mechanical symbol indicators mounted in the housing, each the mechanical symbol indicator including a symbol display linearly movable back and forth within the housing;

a plurality of symbols on each of the symbol displays, wherein a plurality of symbols include a plurality of numerical digits, and wherein the symbol displays are linearly moveable to display an award to a player by displaying the numerical digits on the plurality of symbol displays;

at least one indicator member connected to the housing to simultaneously indicate one of the plurality of symbols on each of the symbol displays; and a processor which controls the mechanical symbol indicators.

19. The gaming device of claim 18, wherein the plurality of symbols includes a plurality of numbers.

20. The gaming device of claim 18, wherein the indicator members include a structure selected from the group consisting of: (a) a fixed mask across a front panel of the housing which defines at least one opening; (b) a plurality of fixed indicators positioned to indicate one of the symbols on each of the symbol displays; (c) a plurality of illuminable indicators; (d) an opaque front panel of the housing which includes at least one see-through area.

21. The gaming device of claim 18, wherein the symbol displays of the mechanical symbol indicators are mounted to move in a substantially vertical linear direction.

22. The gaming device of claim 18, wherein each mechanical symbol indicator includes a lead screw assembly coupled with a motor controlled by the processor to linearly move the symbol display of the symbol indicator within the housing.

23. The gaming device of claim 18, wherein each mechanical symbol indicator includes a position sensor in communication with the processor.

24. The gaming device of claim 23, wherein each position sensor includes a position indicator and a position detector.

25. The gaming device of claim 18, wherein each symbol display includes a tube and a support member rigidly attached to the tube.

26. A gaming device comprising:

a cabinet;

a housing connected to the cabinet;

a game operable upon a wager by a player;

a triggering event associated with the game;

a mechanical symbol indicator mounted in the housing, the mechanical symbol indicator including a plurality of mechanical symbol displays each independently linearly movable within the housing;

a plurality of symbols on the symbol displays; and a processor which controls the mechanical symbol indicator and is adapted to cause after the occurrence of the triggering event associated with the game the mechanical symbol displays to each oscillate back and forth along a linear path and to cause at least one of the symbols to be indicated to display an award which is part of an outcome to provide to the player.

27. The gaming device of claim 26, wherein the plurality of symbols includes a plurality of numbers.

28. The gaming device of claim 26, wherein the plurality of symbols includes a plurality of numerical digits.

29. The gaming device of claim 26, wherein the mechanical symbol displays of the mechanical symbol indicator are each mounted to each move in a substantially vertical linear direction.

30. The gaming device of claim 26, wherein the mechanical symbol displays include a tubular member and a support member rigidly attached to each tubular member.

31. A method of operating a gaming device having a game operable upon a wager, the method comprising:

(a) enabling a player to play the game;

(b) after a triggering event associated with the game, selecting at least one award amount to be provided to the player;

(c) independently linearly moving a plurality of mechanical symbol indicators back and forth, each mechanical symbol indicator including at least one numerical digit; and (d) stopping the linear movement of at least one of the mechanical symbol indicators to indicate one of the numerical digits on the mechanical symbol indicator to display at least part of the award amount to be provided to the player.

32. A gaming device comprising:

a cabinet;

a housing connected to the cabinet;

a plurality of independent mechanical symbol indicators mounted in the housing, the independent mechanical symbol indicators each including a symbol display linearly movable back and forth within the housing, wherein the symbol displays include a tube and a support member rigidly attached to the tube and a plurality of symbols;

at least one indicator member connected to the housing to indicate one of the plurality of symbols of the symbol displays; and a processor which controls the mechanical symbol indicators.

33. A gaming device comprising:

a cabinet;

a housing connected to the cabinet;

a plurality of independent mechanical symbol indicators mounted in the housing, each the mechanical symbol indicator including a symbol display linearly movable back and forth within the housing;

a plurality of symbols on each of the symbol displays, wherein each symbol display includes a tube and a support member rigidly attached to the tube;

at least one indicator member connected to the housing to simultaneously indicate one of the plurality of symbols on each of the symbol displays; and a processor which controls the mechanical symbol indicators.

34. A gaming device comprising:

a cabinet;

a housing connected to the cabinet;

a game operable upon a wager by a player;

a triggering event associated with the game;

a mechanical symbol indicator mounted in the housing, the mechanical symbol indicator including a plurality of mechanical symbol displays each independently linearly movable within the housing, wherein each of the mechanical symbol displays include a tubular member and a support member rigidly attached to said tubular member;

a plurality of symbols on the symbol displays; and a processor which controls the mechanical symbol indicator and is adapted to cause after the occurrence of the triggering event associated with the game the mechanical symbol displays to each oscillate back and forth along a linear path and to cause at least one of the symbols to be indicated to provide an outcome to the player.

35. A gaming device comprising:

a cabinet;

a housing connected to the cabinet;

a game operable upon a wager by a player;

a mechanical symbol indicator mounted in the housing, the mechanical symbol indicator including a plurality of mechanical symbol displays each independently linearly movable within the housing;

a plurality of symbols on the symbol displays, wherein the symbol displays are moveable back and forth along a linear path to display an award to a player; and a processor which controls the mechanical symbol indicator and is programmed to cause at least one of the mechanical symbol displays to move to cause at least one of the symbols to be indicated to provide an outcome to the player, wherein the outcome is based, at least in part, on the award displayed to the player.

36. A gaming device comprising:

a cabinet;

a housing connected to the cabinet;

a plurality of independent mechanical symbol indicators mounted in the housing, the independent mechanical symbol indicators each including a symbol display linearly movable back and forth within the housing, a plurality of symbols on the symbol displays, wherein the mechanical symbol displays are linearly movable to display an award to a player; and a processor which controls the mechanical symbol indicators.

* * * * *